US010064477B2

(12) United States Patent
Nelson

(10) Patent No.: US 10,064,477 B2
(45) Date of Patent: Sep. 4, 2018

(54) HAMMOCK MOUNTED CADDY

(71) Applicant: Edward Scott Nelson, Bradenton Beach, FL (US)

(72) Inventor: Edward Scott Nelson, Bradenton Beach, FL (US)

( * ) Notice: Subject to any disclaimer, the term of this patent is extended or adjusted under 35 U.S.C. 154(b) by 0 days.

(21) Appl. No.: 15/530,105

(22) Filed: Dec. 3, 2016

(65) Prior Publication Data

US 2018/0153284 A1 Jun. 7, 2018

(51) Int. Cl.

| | |
|---|---|
| ***A45F 3/22*** | (2006.01) |
| ***A47G 23/02*** | (2006.01) |
| ***A47C 31/00*** | (2006.01) |
| *A45F 3/00* | (2006.01) |

(52) U.S. Cl.

CPC ..... *A45F 3/22* (2013.01); *A47C 31/00* (2013.01); *A47G 23/0216* (2013.01); *A45F 2003/001* (2013.01)

(58) Field of Classification Search

CPC ..... A47G 23/0216
USPC ..... 5/120–123
See application file for complete search history.

(56) References Cited

U.S. PATENT DOCUMENTS

| | | | | |
|---|---|---|---|---|
| 2,563,156 | A * | 8/1951 | Carl | A45F 3/24 108/50.11 |
| 3,761,044 | A | 9/1973 | Amher | |
| 4,063,701 | A | 12/1977 | Wray | |
| 4,131,259 | A | 12/1978 | Franks | |
| 4,634,089 | A | 1/1987 | Wright et al. | |
| 4,819,843 | A | 4/1989 | Nakayama | |
| 4,887,784 | A | 12/1989 | Kayali | |
| 5,014,956 | A | 5/1991 | Kayali | |
| 5,325,991 | A | 7/1994 | Williams | |
| 5,628,485 | A | 5/1997 | Ray | |
| 5,647,075 | A * | 7/1997 | Perkins | A45F 3/22 108/26 |
| 5,720,458 | A | 2/1998 | Carpenter | |
| D429,969 | S | 8/2000 | Frankel | |
| 6,264,153 | B1 | 7/2001 | Ragner et al. | |
| 6,318,689 | B1 | 11/2001 | Rodriguez | |
| 7,284,737 | B2 | 10/2007 | Kane | |
| 8,231,094 | B1 | 7/2012 | Barnes, Jr. | |
| 8,757,573 | B1 | 6/2014 | Barnes, Jr. | |
| 2002/0145096 | A1 | 10/2002 | Eubanks | |
| 2013/0037586 | A1 | 2/2013 | Richter et al. | |

* cited by examiner

*Primary Examiner* — Fredrick C Conley
(74) *Attorney, Agent, or Firm* — Mark E. Wiemelt

(57) ABSTRACT

A hammock mounted caddy including a mounting base having a mounting mechanism for supportable engagement on hammock cords, a holding framework for holding a drink container, and an intermediate pivotal mechanism interposed between the mounting base and the holding framework, for supportable engagement of the holding framework between hammock cords. The mounting base, holding framework, and intermediate pivotal mechanism being pivotally connected to one another about two axes orthogonally arranged with respect to each other to provide a user with hands-free and spill-resistant retention of drinks. The mounting base may include an item holding portion.

38 Claims, 19 Drawing Sheets

SECTION D-D

HAMMOCK MOUNTED CADDY

BACKGROUND OF THE INVENTION

1. Field of the Invention

The invention generally relates to a caddy for holding drink containers or other items. More specifically, the invention relates to a hammock mounted caddy for holding drink containers or other items.

2. The Prior Art

There are a variety of prior art drink holders. However, prior art drink holders generally provide devices that are not capable of being mounted on a hammock to provide a user with hands-free and spill-resistant retention of drink containers and other items when the hammock moves. There is no satisfactory known solution to this problem provided in the prior art.

It is therefore an objective of this invention to provide a hammock mounted caddy which provides a user with hands-free and spill-resistant retention of drink containers and other items.

SUMMARY OF THE INVENTION

One object of the invention is to provide a novel hammock mounted caddy which provides a user with hands-free and spill-resistant retention of drink containers and other items.

Another object of the invention is to provide a removable hammock mounted caddy which is attachable to hammock cords.

Yet another object of the invention is to provide a hammock mounted caddy which includes a drink holder which retains a drink container in a substantially upright orientation within the drink holder by means of the weight of the drink container and contents, so as to thereby effectively prevent the contents, particularly liquid contents, from spilling out of the drink container when the hammock moves.

Still another object of the invention is to provide a hammock mounted caddy which includes a drink holder which is supportable between hammock cords and which retains a drink container in a substantially upright orientation within the drink holder by means of the weight of the drink container and contents, so as to thereby effectively prevent the contents, particularly liquid contents, from spilling out of the drink container when the hammock moves.

These together with other objects of the present invention, along with the various features of novelty which characterize the present invention, are pointed out with particularity in the claims annexed to and forming a part of this disclosure. For a better understanding of the present invention, its operating advantages and the specific objects attained by its uses, reference should be had to the accompanying drawings and descriptive matter in which there is illustrated a preferred embodiment of the present invention and alternative embodiments.

In a preferred embodiment, a hammock mounted caddy is provided including a mounting base having a mounting mechanism, a holding framework for holding a drink container, and an intermediate pivotal mechanism interposed between the mounting base and the holding framework. In use, the holding framework is positioned between hammock cords and the mounting base is positioned on hammock cords to provide supportable engagement of the hammock mounted caddy. A mounting mechanism includes retention members which selectively and frictionally engage hammock cords when the mounting base is supportably positioned on hammock cords. The mounting base, holding framework, and intermediate pivotal mechanism being pivotally connected to one another about two axes orthogonally arranged with respect to each other to provide a user with hands-free and spill-resistant retention of drinks. The holding framework is constructed to removably receive at least the bottom portion of a drink container. At least the lower portion of the holding framework defines apertures for allowing liquid to drain therefrom. The upper portion of the holding framework includes a pair of generally radially extending shaft portions which are received in pivotal engagement within a pair of respective shaft carrying portions of the intermediate pivotal mechanism about an axis orthogonally arranged with respect to the intermediate pivotal mechanism and the intermediate pivotal mechanism includes a pair of generally radially extending shaft portions which are received in pivotal engagement within a pair of respective shaft carrying portions of the mounting base about an axis orthogonally arranged with respect to the mounting base, to provide a user with hands-free and spill-resistant retention of drink containers. The mounting base may include an item holding portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention.

Before explaining the preferred embodiment and alternative embodiments of the present invention in detail, it is to be understood that the present invention is not limited in its application to the details of construction, to the arrangements of the components set forth in the following description or illustrated in the drawings, or to the methods described therein. The present invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the present invention in any way.

DETAILED DESCRIPTION OF THE PREFERRED EMBODIMENT

Figure 1:
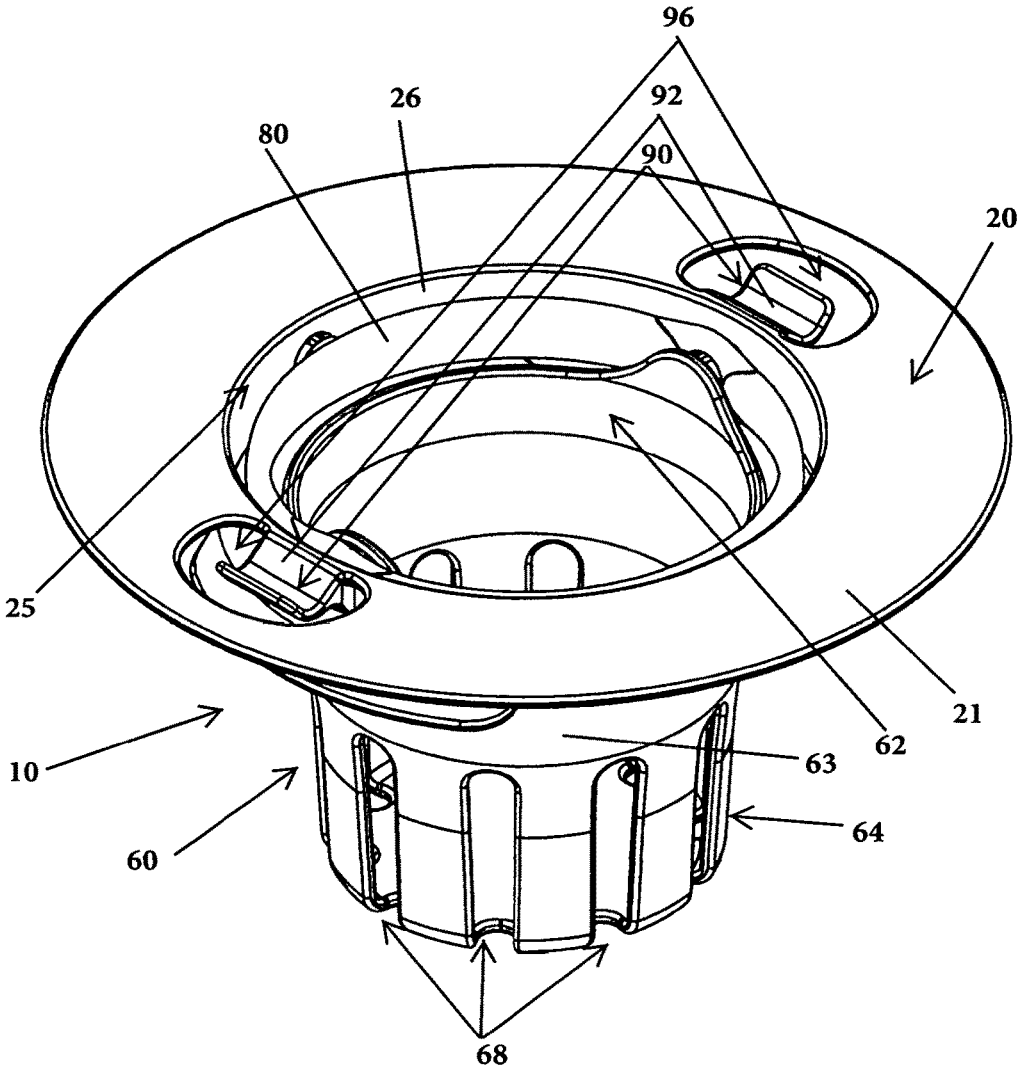
FIG. 1 is a perspective view of a preferred embodiment of the invention.

While this present invention is susceptible of embodiments in many different forms, there are shown in the drawings and will be described in detail herein, a preferred embodiment, with like parts designated by like reference numerals and with the understanding that the present disclosure is to be considered as an exemplification of the principles of the present invention, and is not intended to limit the claims to the illustrated preferred embodiment.

Figure 2:
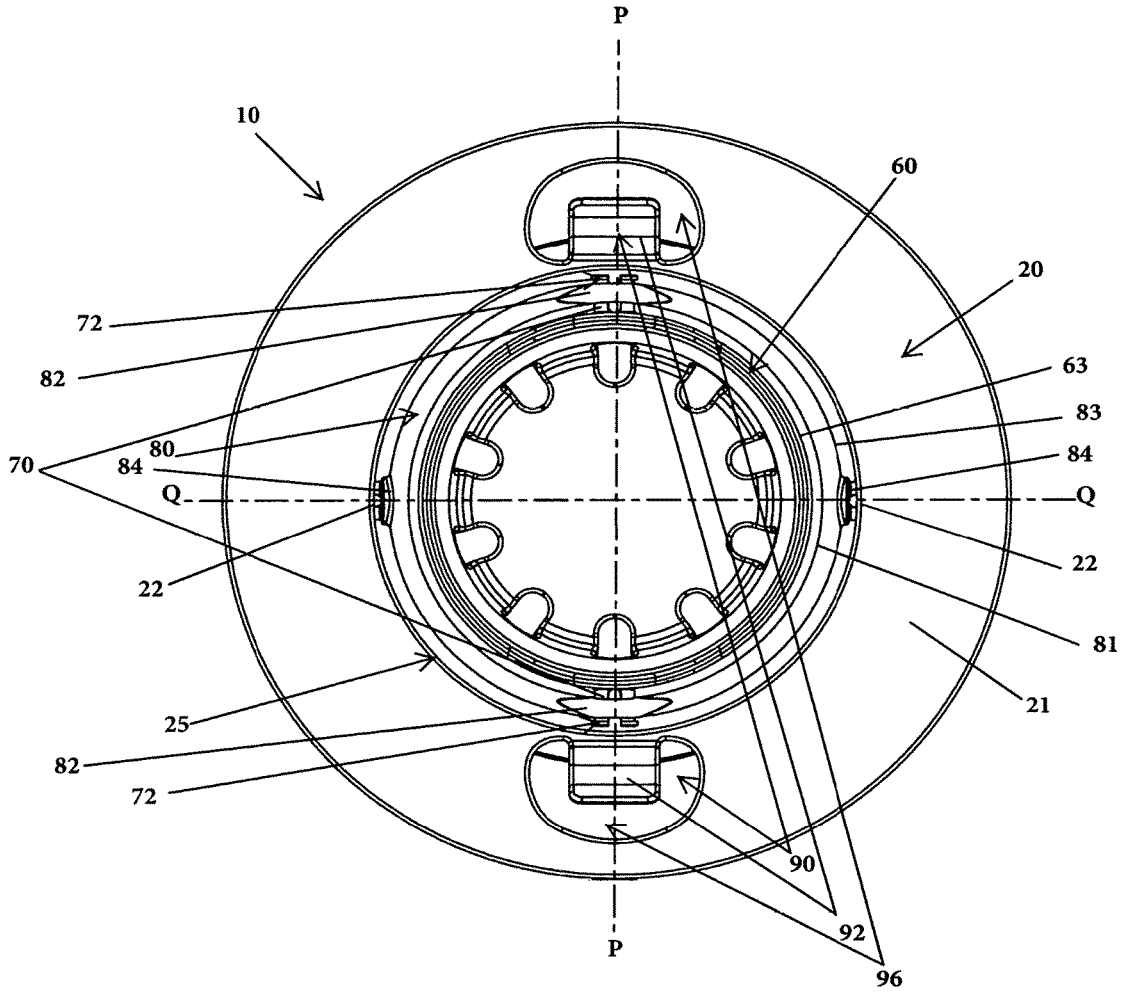
FIG. 2 is a top plan view of a preferred embodiment of the invention.
Figure 3:
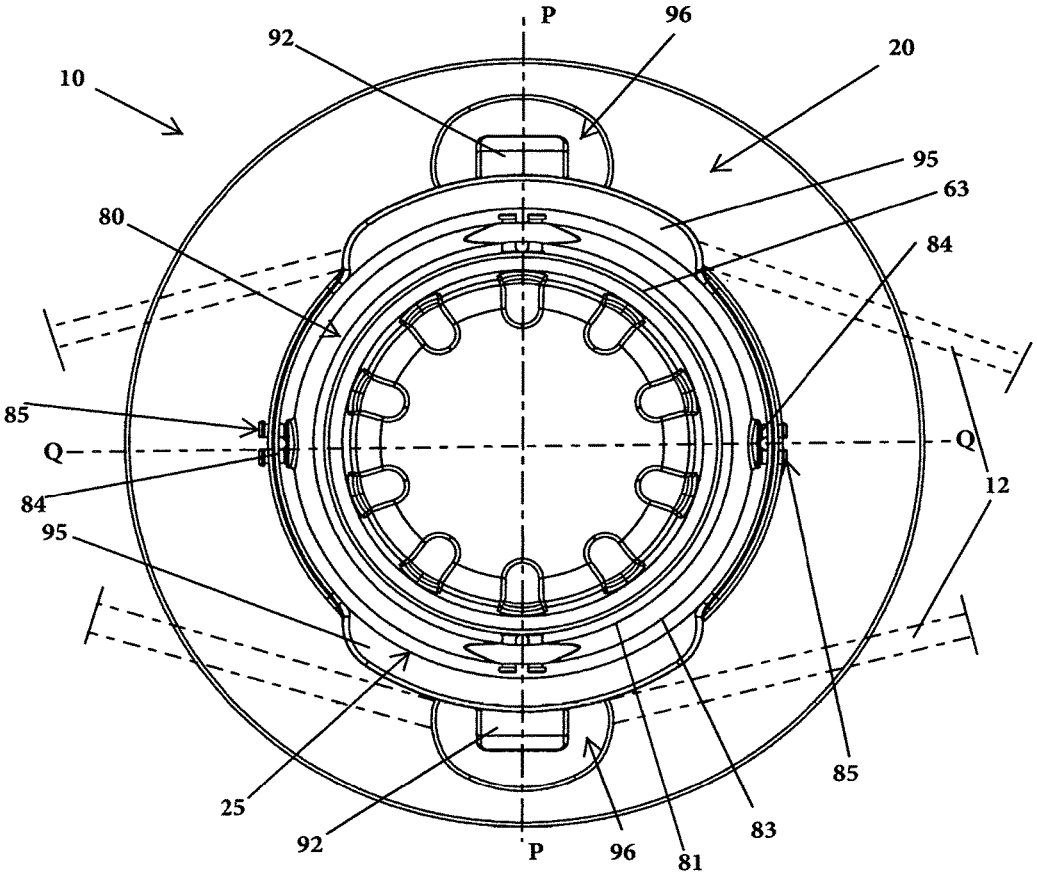
FIG. 3 is a bottom plan view of a preferred embodiment of the invention.
Figure 4:
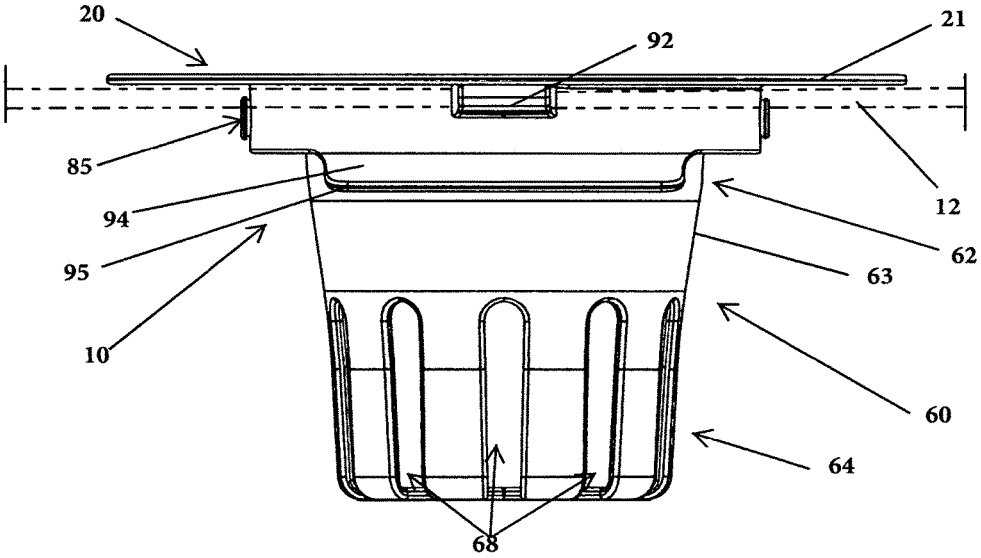
FIG. 4 is a front elevation view of a preferred embodiment of the invention.
Figure 5:
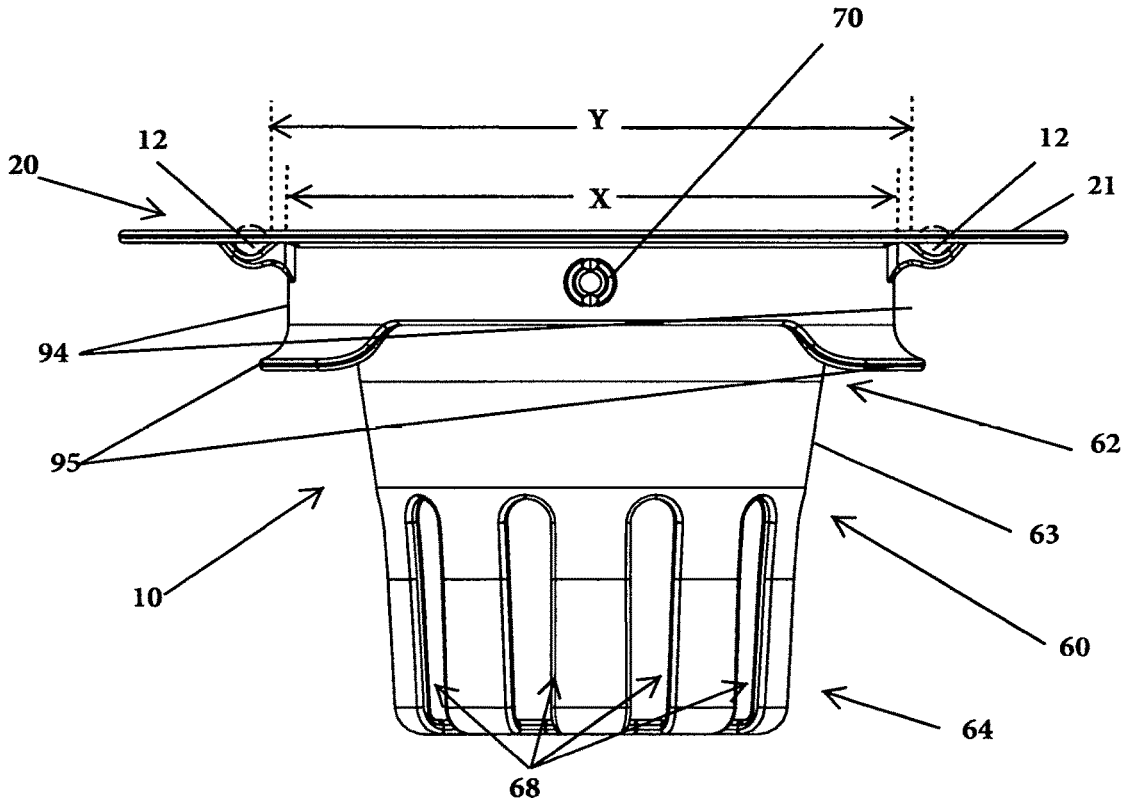
FIG. 5 is a side elevation view of a preferred embodiment of the invention.
Figure 6:
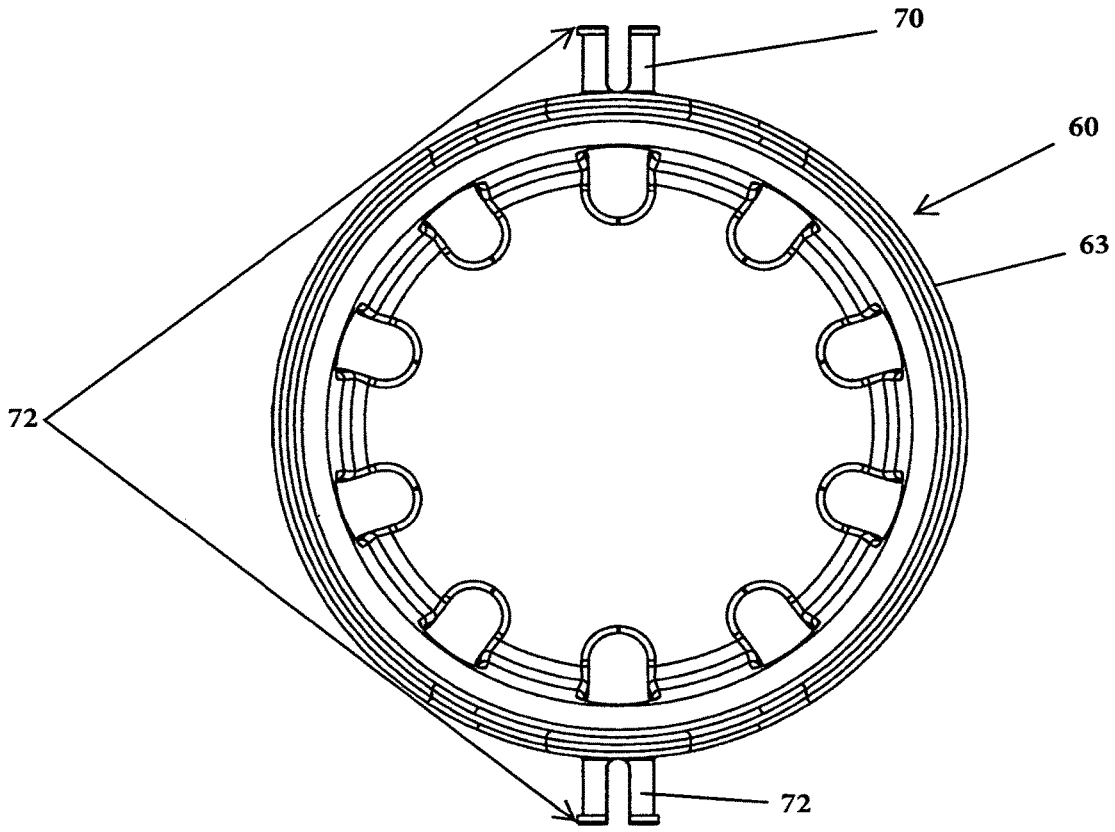
FIG. 6 is a top plan view of a holding framework of a preferred embodiment of the invention.
Figure 7:
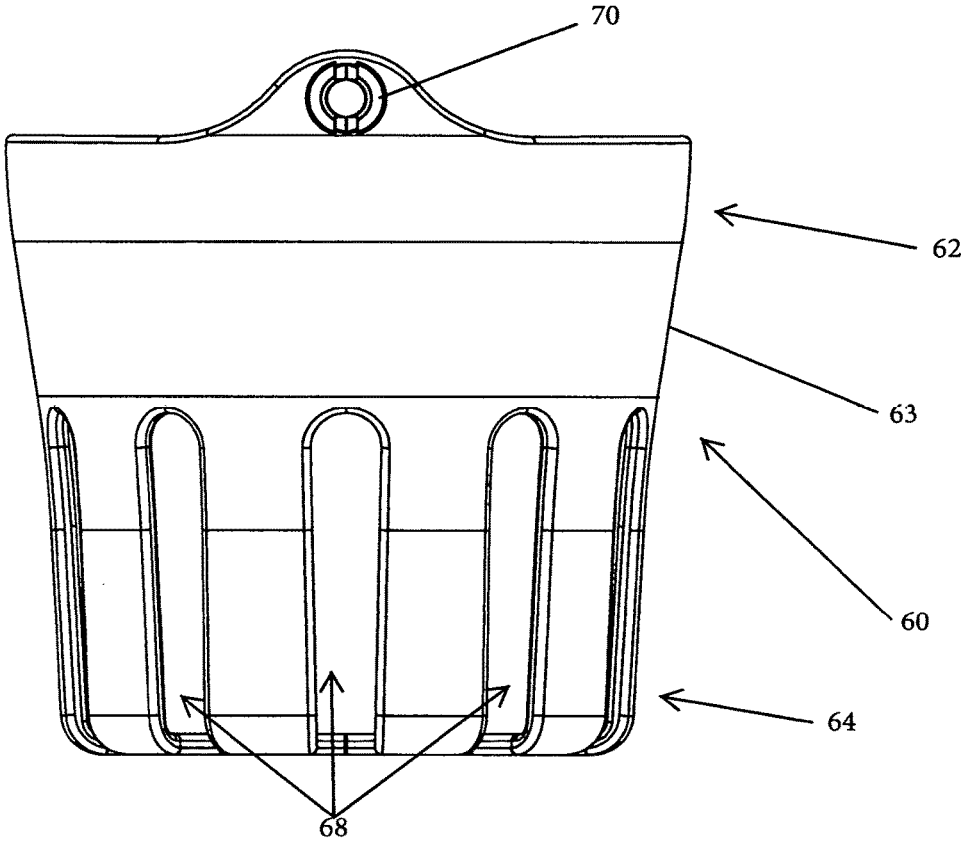
FIG. 7 is a front elevation view of a holding framework of a preferred embodiment of the invention.
Figure 8:
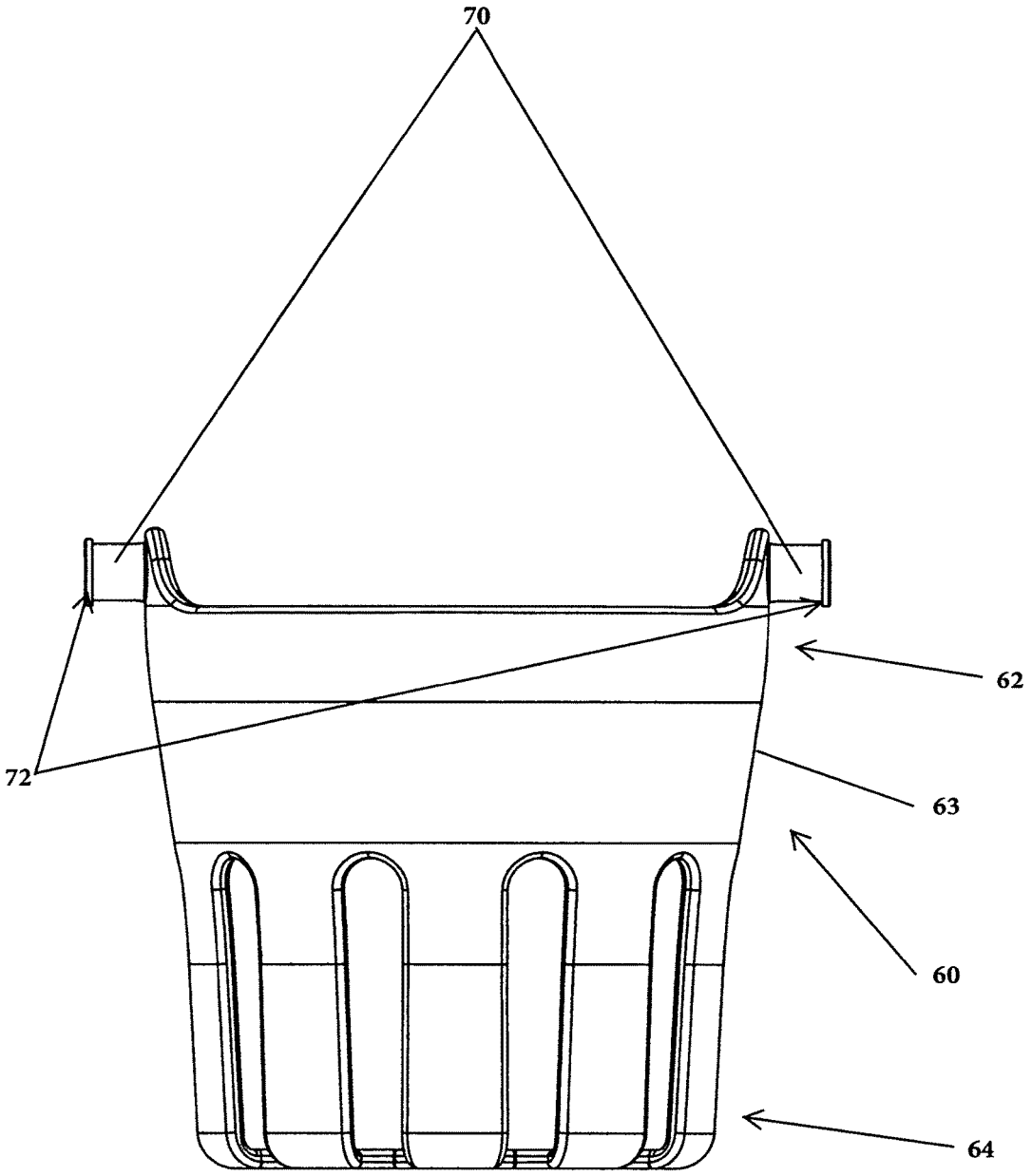
FIG. 8 is a side elevation view of a holding framework of a preferred embodiment of the invention.
Figure 9:
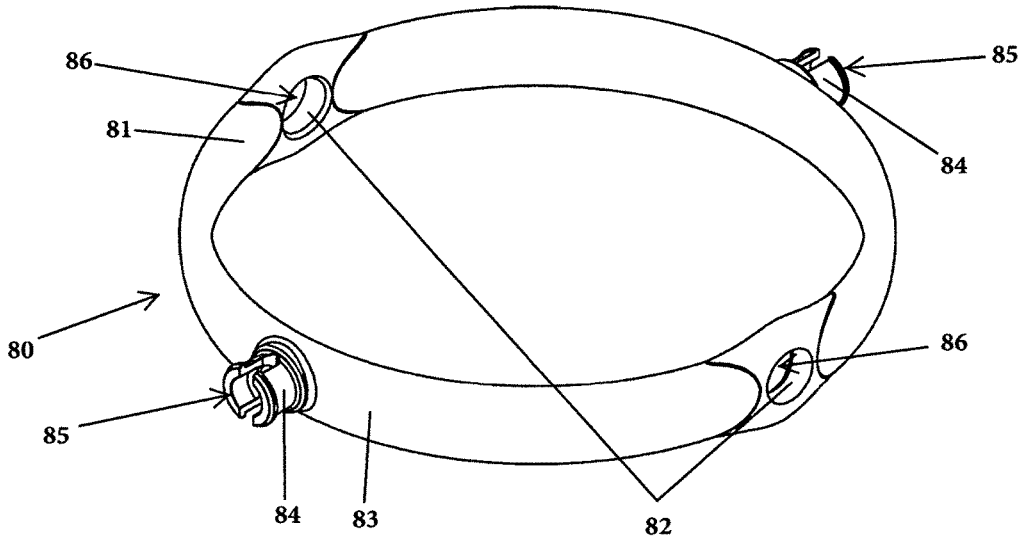
FIG. 9 is a perspective view of an intermediate pivotal mechanism of a preferred embodiment of the invention.
Figure 10:
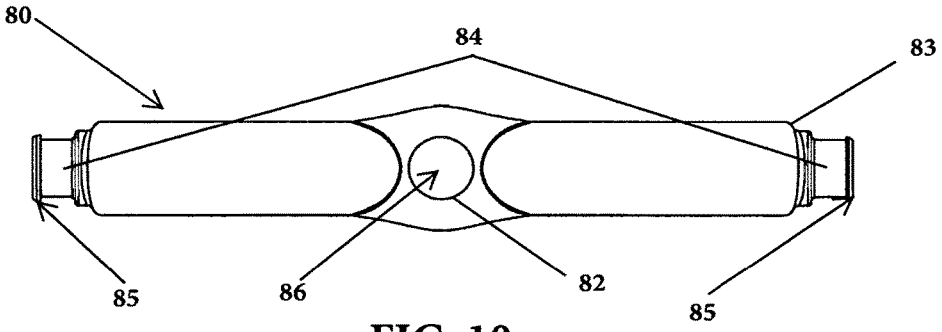
FIG. 10 is a front elevation view of an intermediate pivotal mechanism of a preferred embodiment of the invention.
Figure 11:
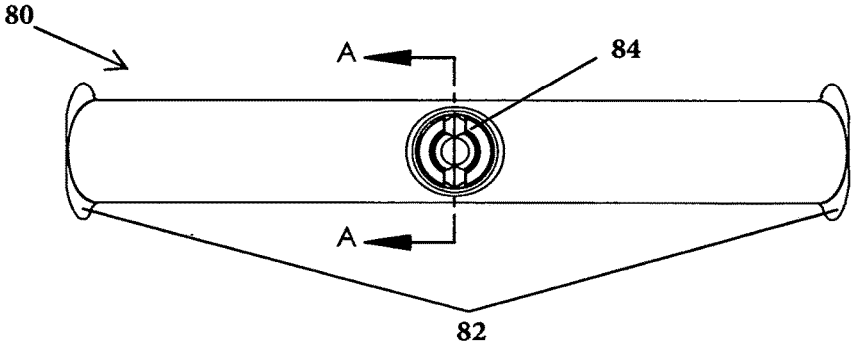
FIG. 11 is a side elevation view of an intermediate pivotal mechanism of a preferred embodiment of the invention.
Figure 12:
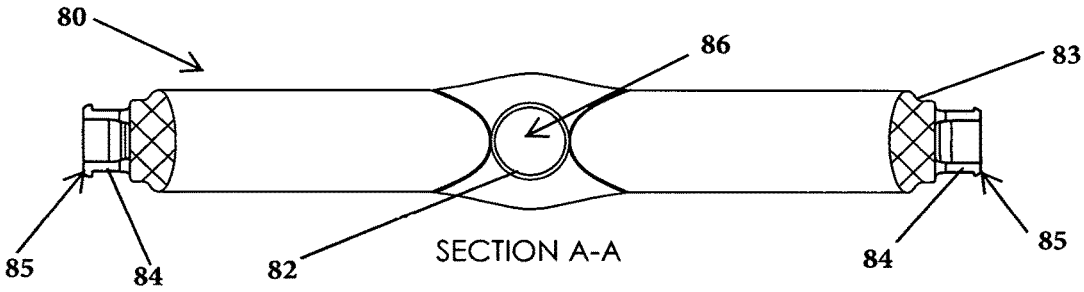
FIG. 12 is a sectional view taken along line A-A of FIG. 11.
Figure 13:
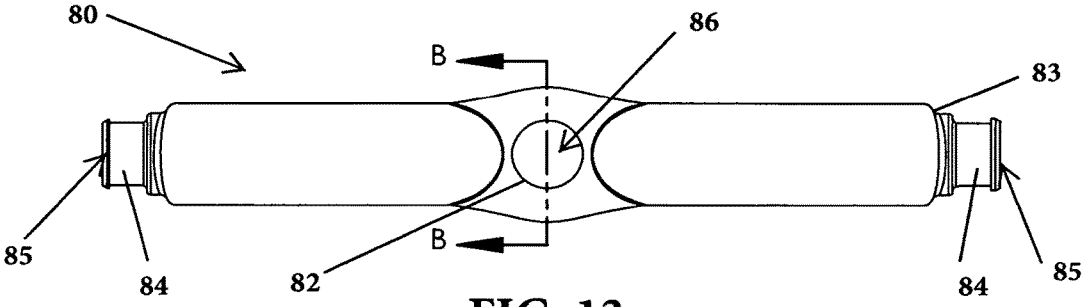
FIG. 13 is a front elevation view of an intermediate pivotal mechanism of a preferred embodiment of the invention.
Figure 14:
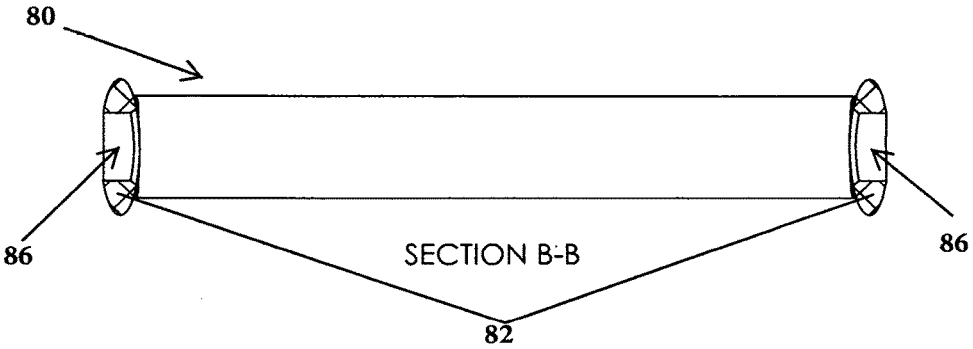
FIG. 14 is a sectional view taken along line B-B of FIG. 13.
Figure 15:
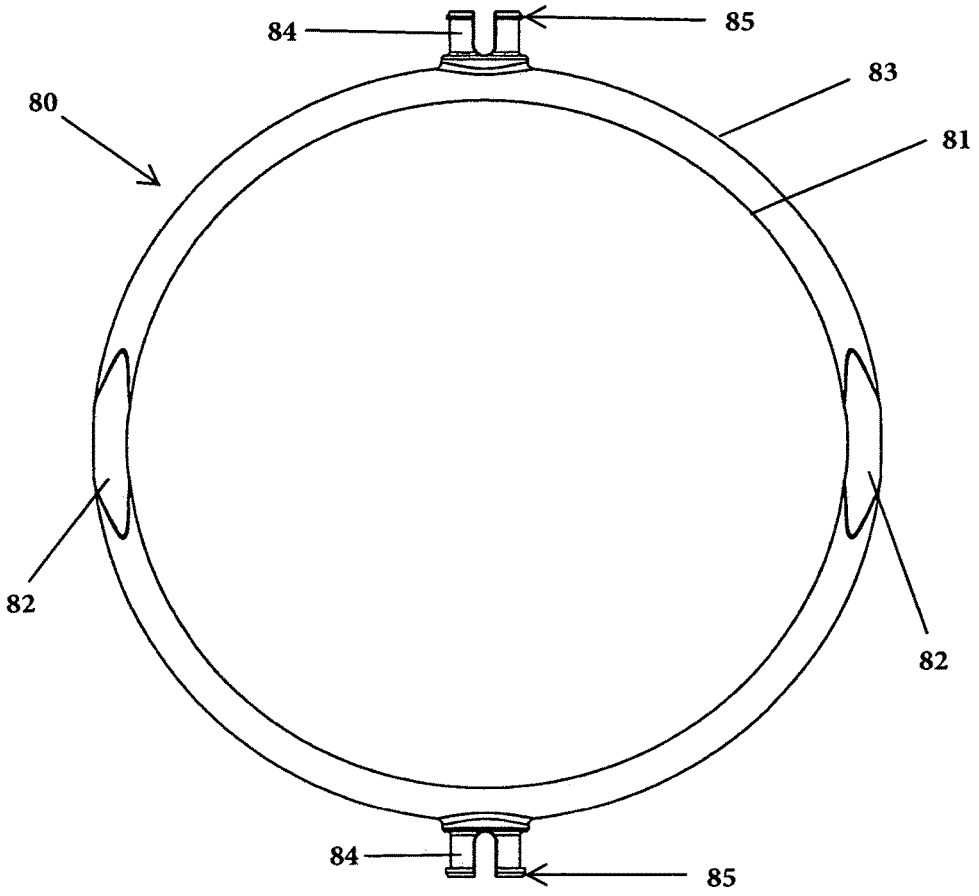
FIG. 15 is a top plan view of an intermediate pivotal mechanism of a preferred embodiment of the invention.

Referring now to FIGS. 1-15, a preferred embodiment of the hammock mounted caddy 10 includes a mounting base 20 for supportable engagement on cords 12 of a hammock (not shown), a holding framework 60 for holding a drink container (not shown), and an intermediate pivotal mechanism 80 interposed between the mounting base 20 and the holding framework 60.

The holding framework 60 is constructed to removably receive at least a bottom portion of a drink container (not shown). The holding framework 60 is generally cup-shaped and has a lower portion 64 and an upper portion 62 having an outer peripheral surface 63. At least the lower portion 64 of the holding framework 60 defines apertures 68 for allowing liquid to drain therefrom. It should be readily understood by those skilled in the art that the holding framework 60 may be constructed of alternate shapes, such as square or rectangle, without departing from the scope and spirit of the invention. It should also be readily understood by those skilled in the art that the holding framework 60 may be any size suitable to removably receive and support a variety of sizes and shapes of drink containers. It should also be readily understood by those skilled in the art that the holding framework 60 need not contain apertures 68 for allowing liquid to drain therefrom, without departing from the scope and spirit of the invention.

The outer peripheral surface 63 of the upper portion 62 of the holding framework 60 includes a pair of generally radially extending shaft portions 70 having distal ends 72. The generally radially extending shaft portions 70 are disposed at symmetrically opposed positions on the outer peripheral surface 63 of the upper portion 62 of the holding framework 60 along a first pivot axis P-P.

The intermediate pivotal mechanism 80 is generally ring-shaped having an inner peripheral surface 81 defining a pair of shaft carrying portions 82 and an outer peripheral surface 83 having a pair of generally radially extending shaft portions 84 having distal ends 85. The generally radially extending shaft carrying portions 82 are disposed at symmetrically opposed positions on the inner peripheral surface 81 of the intermediate pivotal mechanism 80 along the first pivot axis P-P. The generally radially extending shaft portions 84 are disposed at symmetrically opposed positions on the outer peripheral surface 83 of the intermediate pivotal mechanism 80 along a second pivot axis Q-Q. The first pivot axis P-P and the second pivot axis Q-Q intersect at generally right angles. The shaft carrying portions 82 of the intermediate pivotal mechanism 80 define apertures 86 to pivotally receive distal ends 72 of respective shaft portions 70 of the holding framework 60. The mounting base 20, holding framework 60, and intermediate pivotal mechanism 80 are concentrically connected. It should be readily understood by those skilled in the art that the shaft carrying portions 82 of the intermediate pivotal mechanism 80 may alternatively define a recess to pivotally receive distal ends 72 of respective shaft portions 70, without departing from the scope and spirit of the invention. The intermediate pivotal mechanism 80 is sized to receive therethrough the holding framework 60.

The mounting base 20 includes a generally planar top surface 21 and an inner peripheral surface 26 defining an aperture 25 sized to receive therethrough the intermediate pivotal mechanism 80. The mounting base 20 includes a pair of generally radially extending shaft carrying portions 22. The generally radially extending shaft carrying portions 22 are disposed at symmetrically opposed positions on the inner peripheral surface 26 of the mounting base 20 along the second pivot axis Q-Q. The shaft carrying portions 22 of the mounting base 20 pivotally receive distal ends 85 of respective shaft portions 84 therein. However, it should be readily understood by those skilled in the art that the shaft carrying portions 22 of the mounting base 20 may alternatively define a recess to pivotally receive distal ends 85 of respective shaft portions 84, without departing from the scope and spirit of the invention The generally radially extending shaft portions 70 of the holding framework 60 are received in pivotal engagement within respective shaft carrying portions 82 of the intermediate pivotal mechanism 80 about an axis orthogonally arranged with respect to the intermediate pivotal mechanism 80 and the generally radially extending shaft portions 84 are received in pivotal engagement within respective shaft carrying portions 22 of the mounting base 20 about an axis orthogonally arranged with respect to the mounting base 20, to provide a user with hands-free and spill-resistant retention of drinks.

It should be readily understood by those skilled in the art that alternatively the upper portion 62 of the holding framework 60 may include shaft carrying portions which receive in pivotal engagement generally radially extending shaft portions of the intermediate pivotal mechanism 80 and the mounting base 20 may include shaft carrying portions which receive in pivotal engagement generally radially extending shaft portions of the intermediate pivotal mechanism 80, to provide a user with hands-free and spill-resistant retention of drinks, without departing from the scope and spirit of the invention.

In the preferred embodiment, the mounting base 20, holding framework 60, and intermediate pivotal mechanism 80 are pivotally connected to one another about two axes orthogonally arranged with respect to each other to provide a user with hands-free and spill-resistant retention of drinks. The mounting base 20, holding framework 60 for holding a drink container, and intermediate pivotal mechanism 80 are connected to provide a pair of cooperative gimbals. It should be readily understood by those skilled in the art that the hammock mounted caddy 10 may employ other gimbal or self-leveling constructions to provide a user with hands-free and spill-resistant retention of drinks, without departing from the scope and spirit of the invention.

The mounting base 20, holding framework 60, and intermediate pivotal mechanism 80 are each constructed of injection-molded plastic. However, it should be readily understood by those skilled in the art that the mounting base 20, holding framework 60, and intermediate pivotal mechanism 80 may be constructed of other suitable substantially rigid materials, without departing from the scope and spirit of the invention.

In use, the holding framework 60 is removably positioned between hammock cords 12 such that the mounting base 20 is generally resting on the hammock cords 12.

In the preferred embodiment, the mounting base 20 includes a mounting mechanism 90. The mounting mechanism 90 includes a pair of elongated collars 94 extending generally vertically downwardly from the top surface 21 of the mounting base 20, the collars 94 having lower flanges 95 that extend generally horizontally outwardly therefrom. In use, the collars 94 selectively engage hammock cords 12 to maintain a predetermined opening X between hammock cords 12 when the holding framework 60 is positioned between hammock cords 12. In use, the collars 94 also provide stability to the mounting base 20 against rotation by engaging a length of the hammock cords 12. It should be readily understood by those skilled in the art that alternatively the mounting mechanism may have one annular collar rather than a pair of collars 94, without departing from the scope and spirit of the invention. It should be readily understood by those skilled in the art that alternatively the mounting base 20 may be immovably secured to hammock cords 12, without departing from the scope and spirit of the invention.

In the preferred embodiment, the mounting mechanism 90 also includes retention members 92 which selectively and frictionally engage hammock cords 12 when the mounting base 20 is positioned on hammock cords 12. The retention members 92 are generally u-shaped and extend downwardly through apertures 96 defined in the top surface 21 of the mounting base 20. In use, the retention members 92 frictionally engage hammock cords 12. However, it should be readily understood by those skilled in the art that the mounting mechanism 90 need not have retention members 92, without departing from the scope and spirit of the invention. It should also be readily understood by those skilled in the art that alternatively the mounting mechanism need not have collars 94 and the retention members 92 may engage hammock cords 12 to maintain a predetermined opening Y between hammock cords 12 when the holding framework 60 is positioned between hammock cords 12, without departing from the scope and spirit of the invention. It should also be readily understood by those skilled in the art that alternatively the retention members 92 may be a variety of known fasteners, such as clips, straps, clasps, brackets, loops, threaded fasteners, hook-and-loop fasteners, or the like, without departing from the scope and spirit of the invention.

Figure 16:
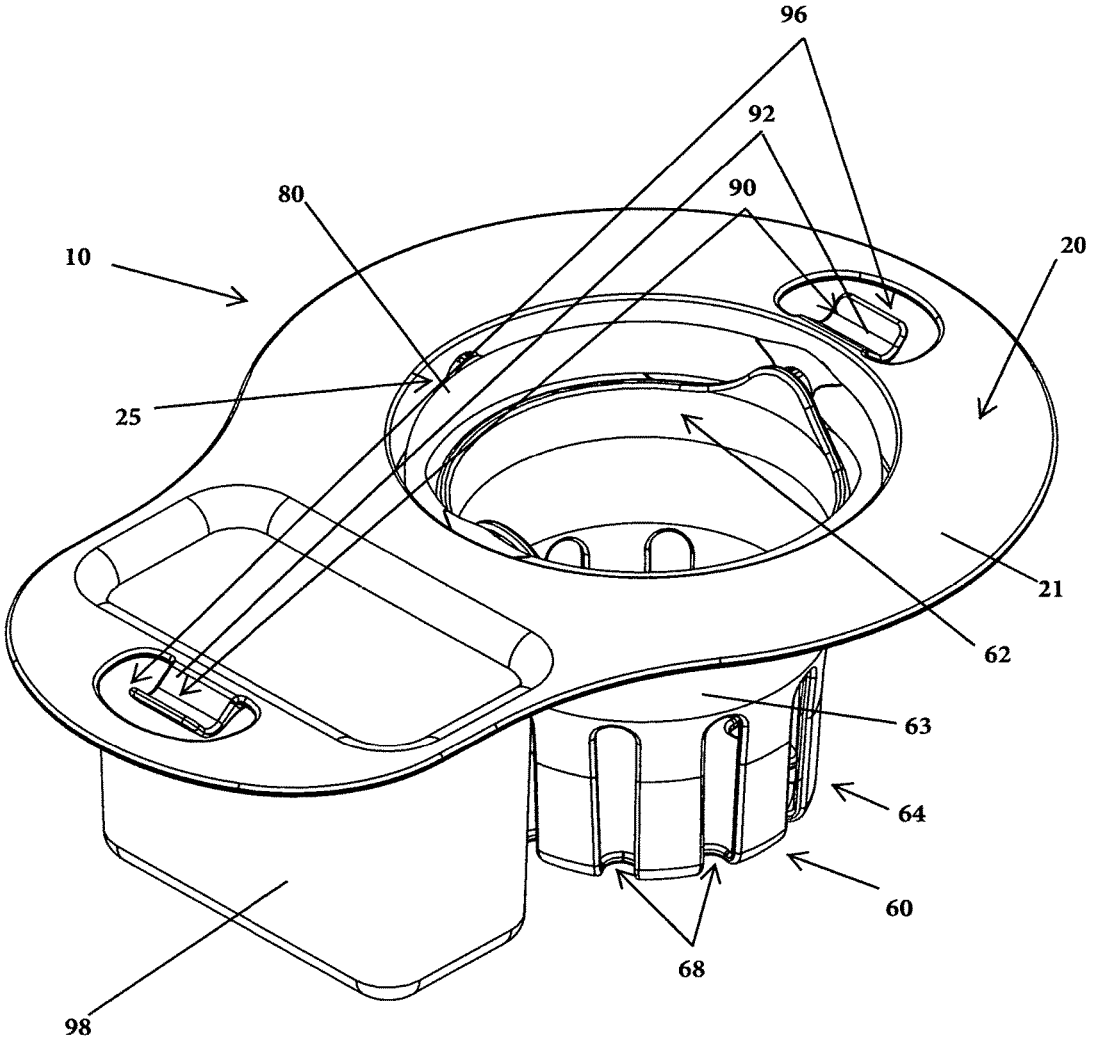
FIG. 16 is a perspective view of an alternative embodiment of the invention.
Figure 17:
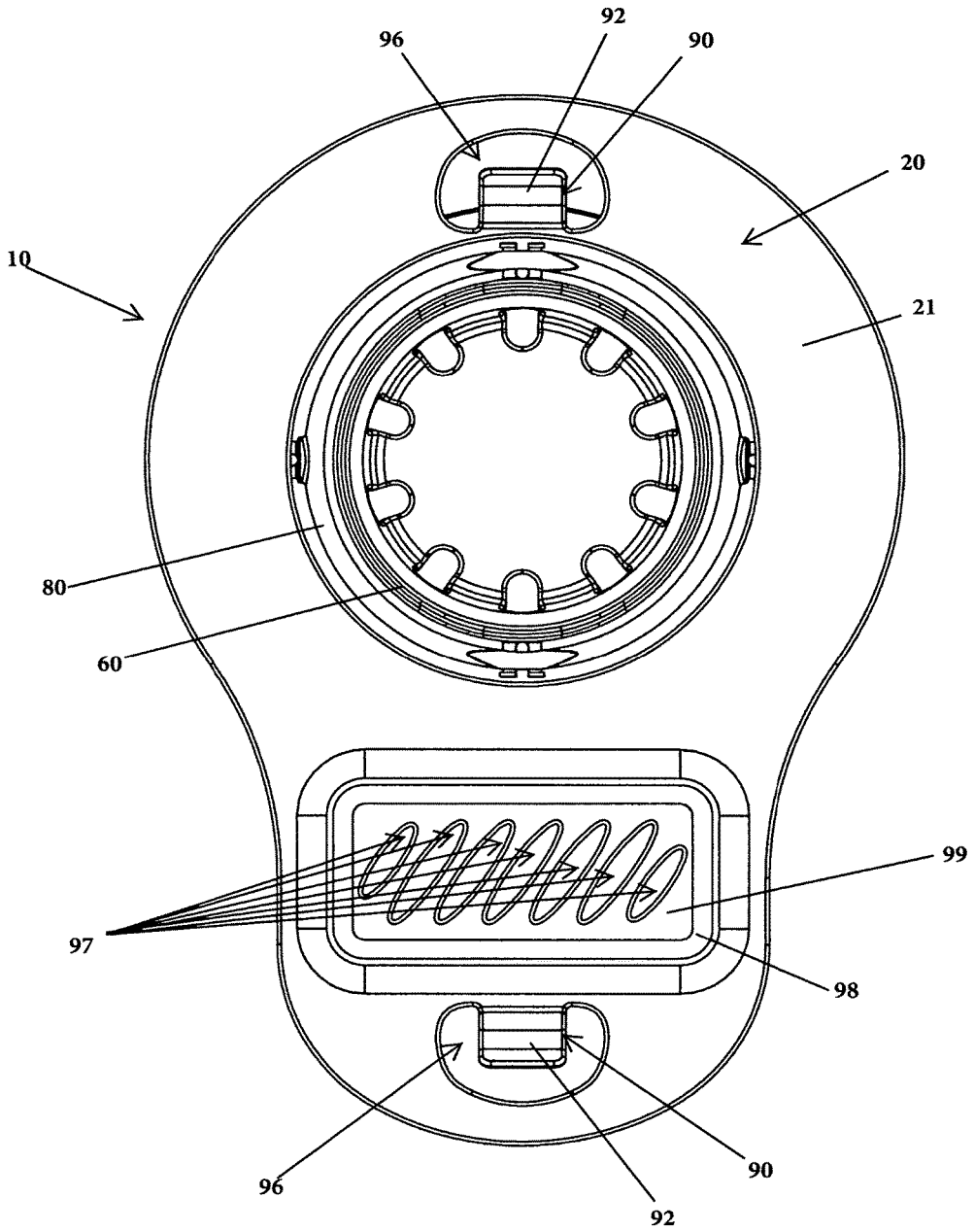
FIG. 17 is a top plan view of an alternative embodiment of the invention.
Figure 18:
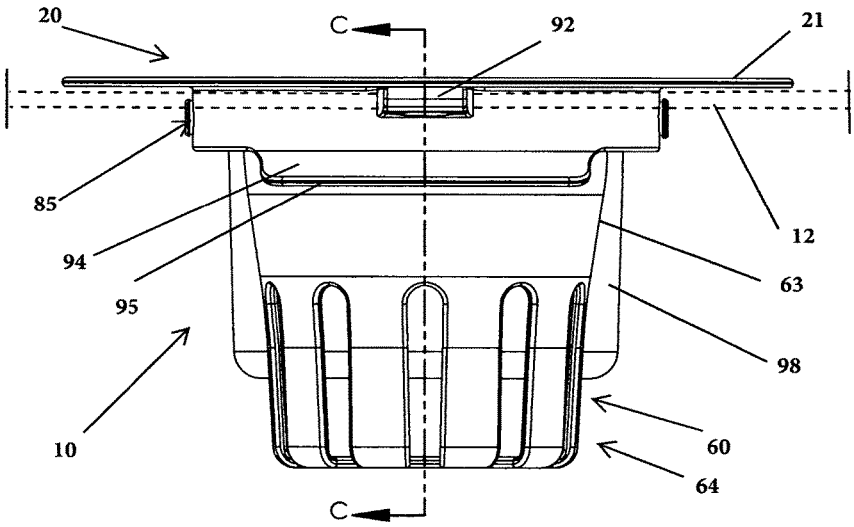
FIG. 18 is a front elevation view of an alternative embodiment of the invention.
Figure 19:
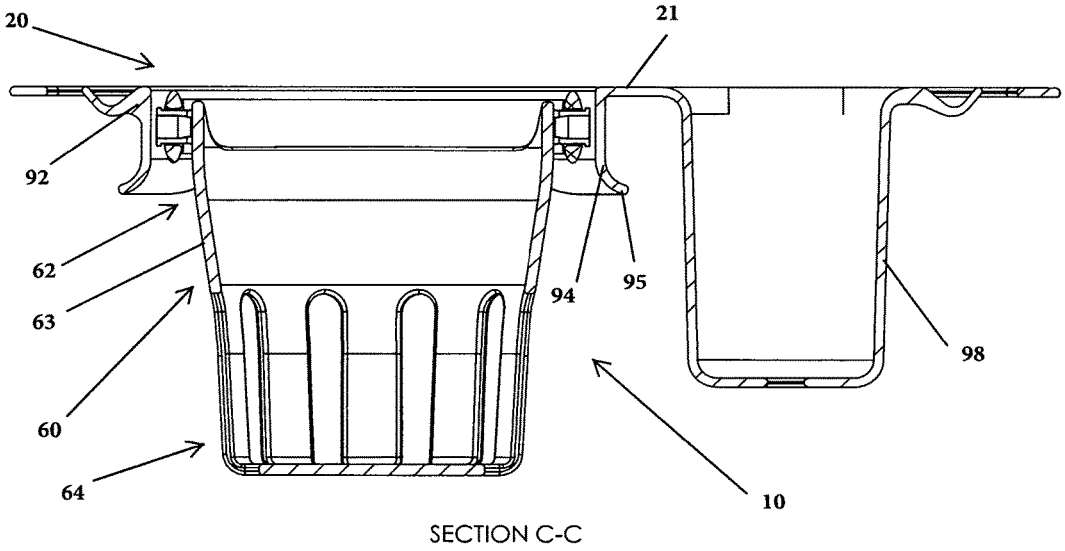
FIG. 19 is a sectional view taken along line C-C of FIG. 18.
Figure 20:
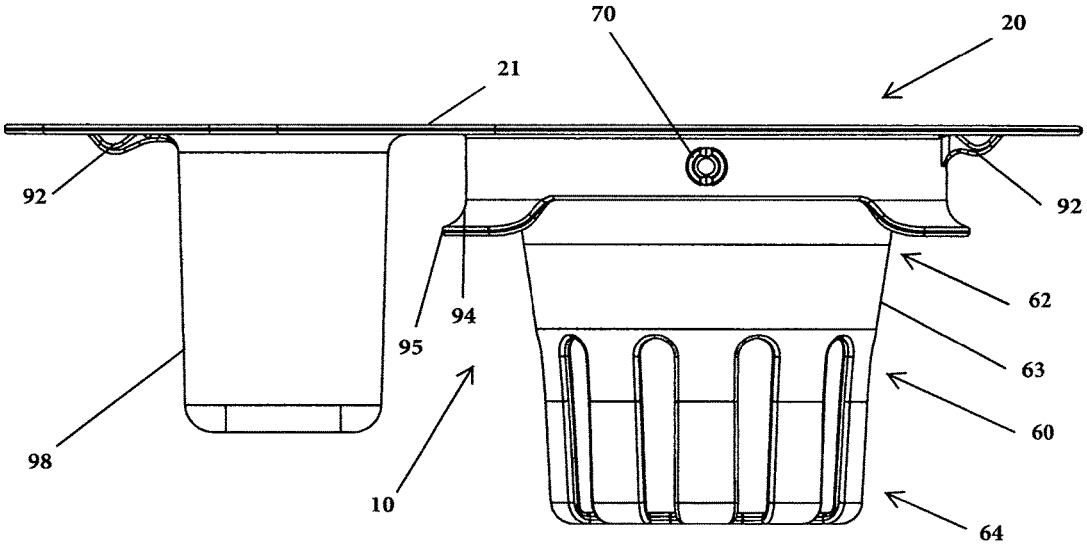
FIG. 20 is a side elevation view of an alternative embodiment of the invention.
Figure 21:
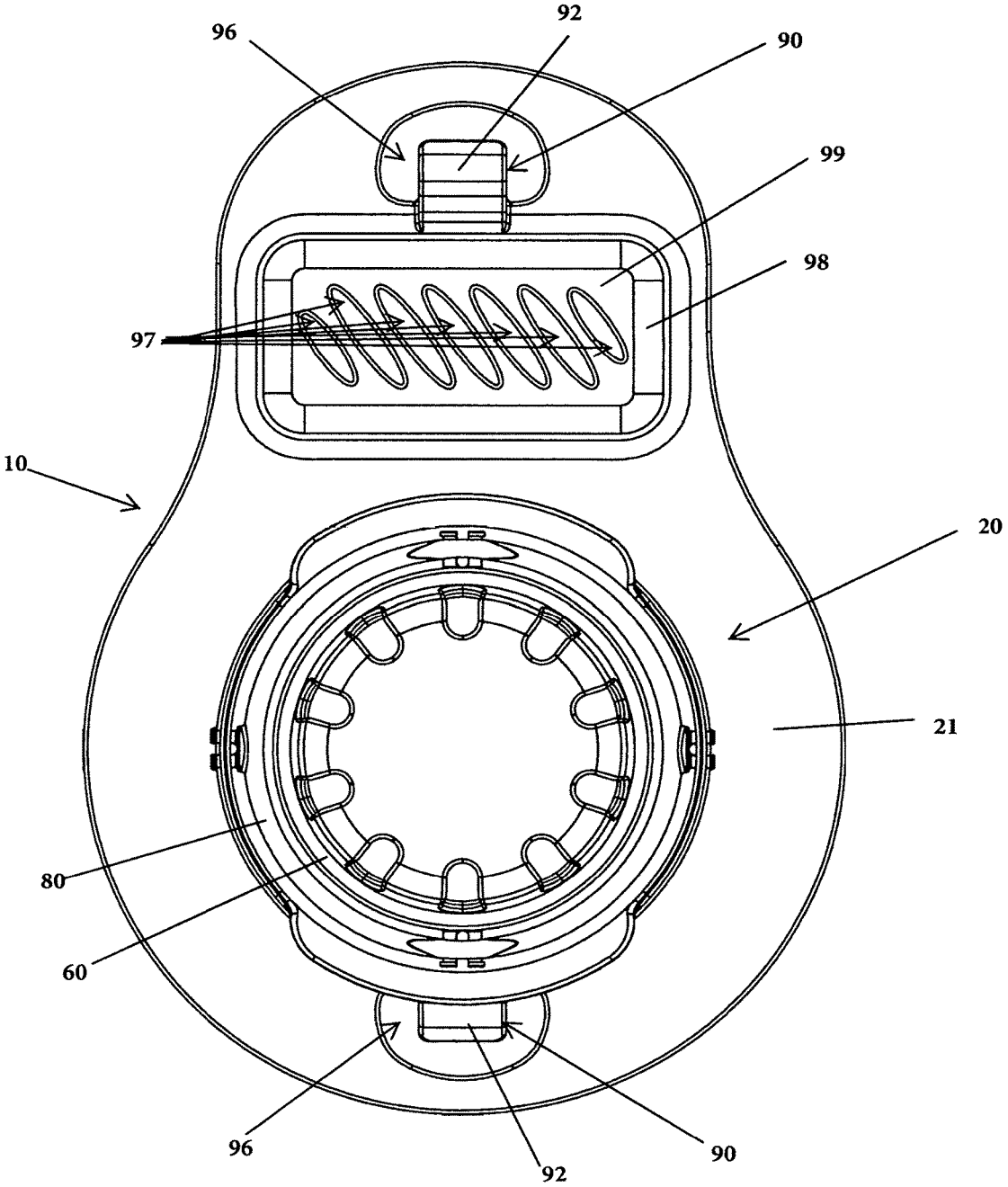
FIG. 21 is a bottom plan view of a mounting base of an alternative embodiment of the invention.

Referring now to FIGS. 16-21, an alternative embodiment of the hammock mounted caddy 10 includes a generally rectangular item holding portion 98 integrally formed within a mounting base 20. However, it should be readily understood by those skilled in the art that the item holding portion 98 may be constructed of alternate shapes, such as square or cylindrical, without departing from the scope and spirit of the invention. It should also be readily understood by those skilled in the art that more than one item holding portion 98 or holding framework 60, or combination thereof, may be included, without departing from the scope and spirit of the invention. At least the bottom 99 of the item holding portion 98 defines apertures 97 for allowing liquid to drain therefrom.

Figure 22:
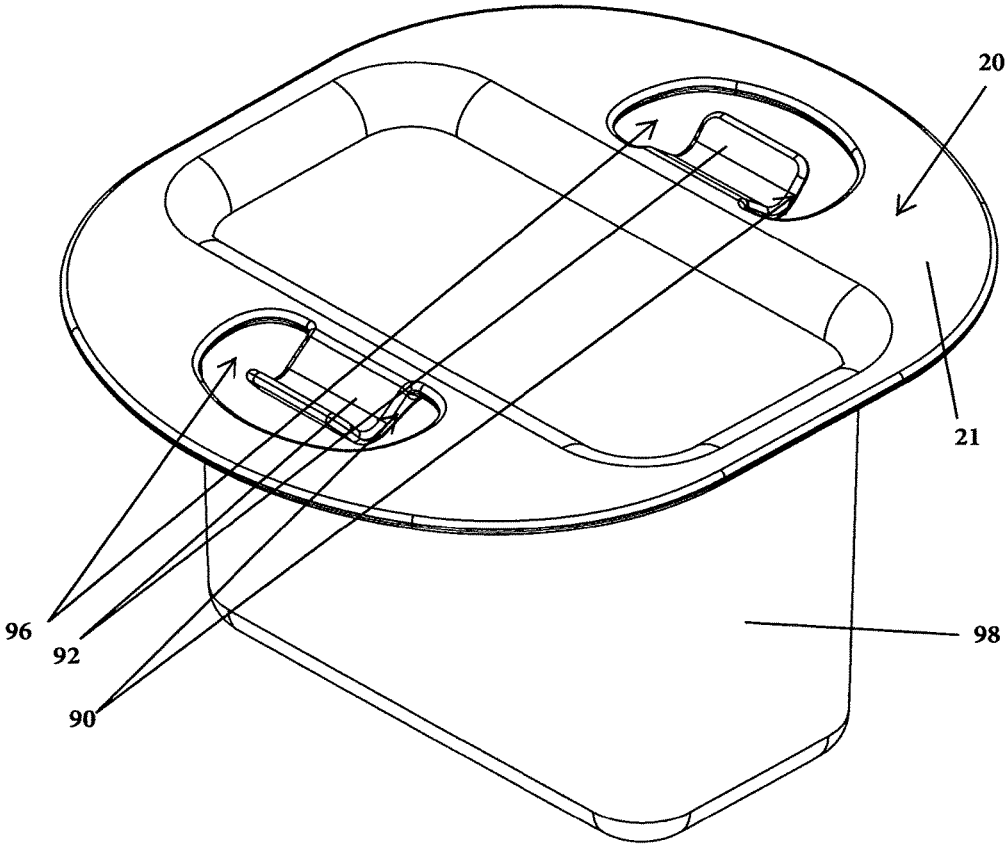
FIG. 22 is a perspective view of a mounting base of another alternative embodiment of the invention.
Figure 23:
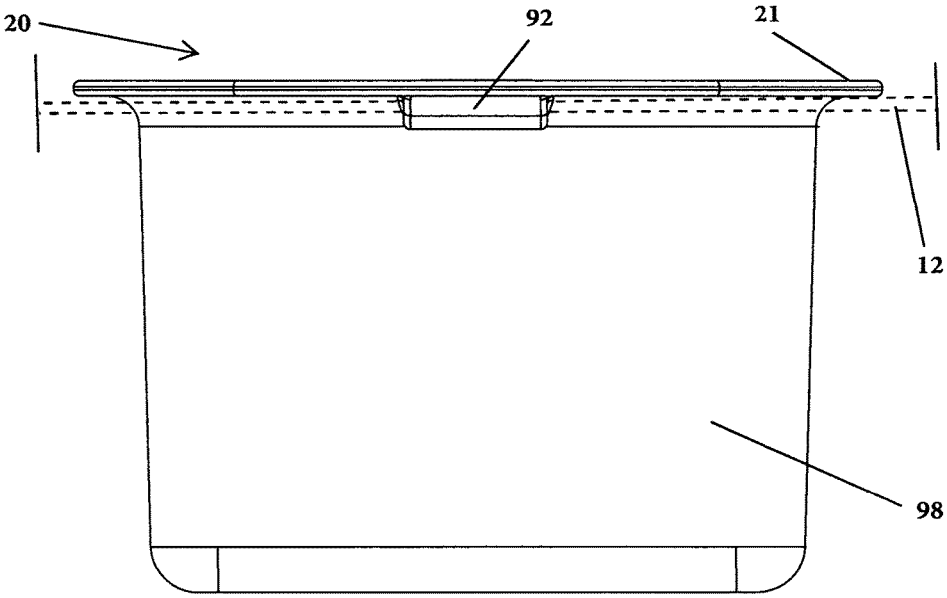
FIG. 23 is a front elevation view of an intermediate pivotal mechanism of another alternative embodiment of the invention.
Figure 24:
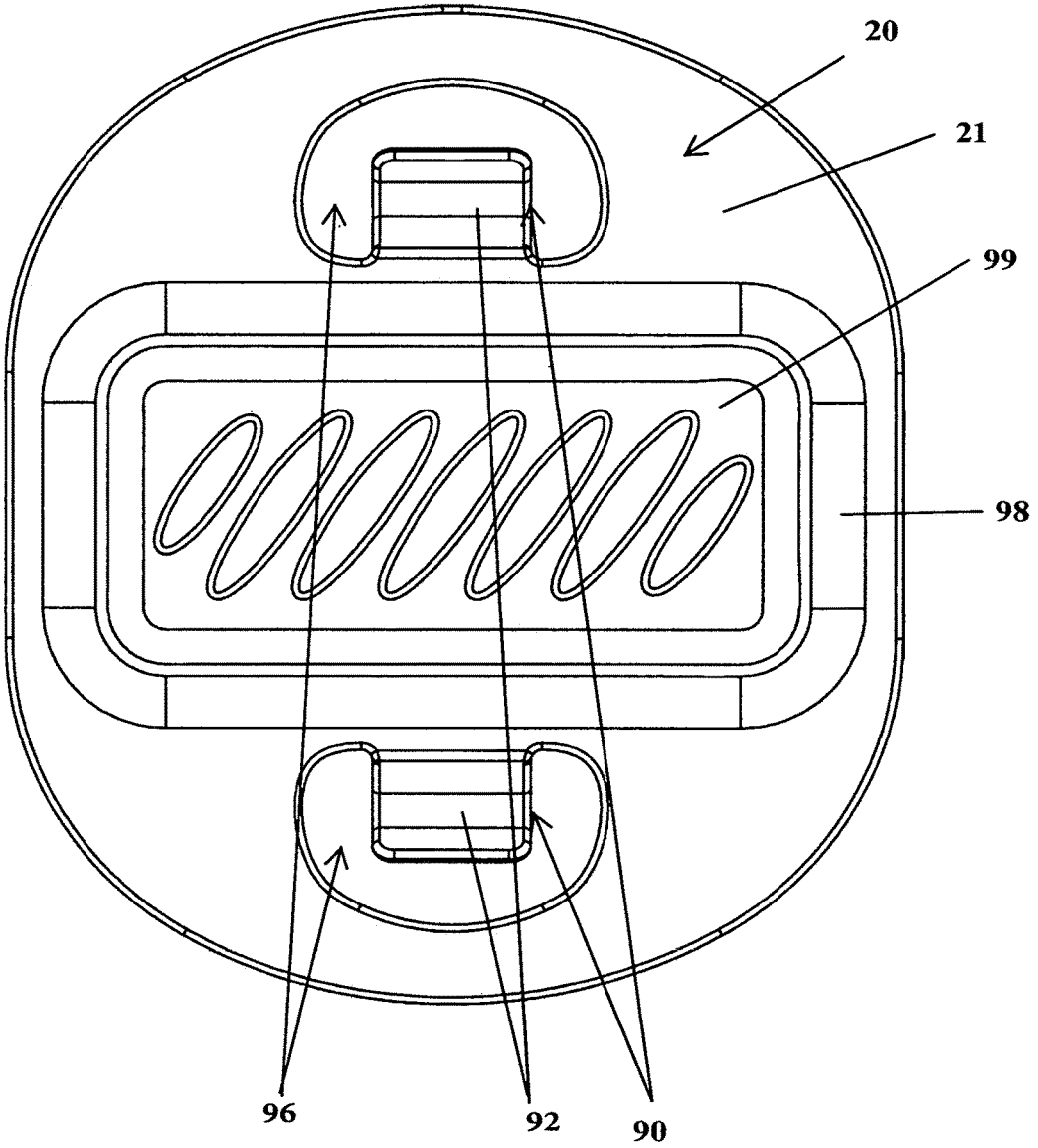
FIG. 24 is a top plan view of an intermediate pivotal mechanism of another alternative embodiment of the invention.
Figure 25:
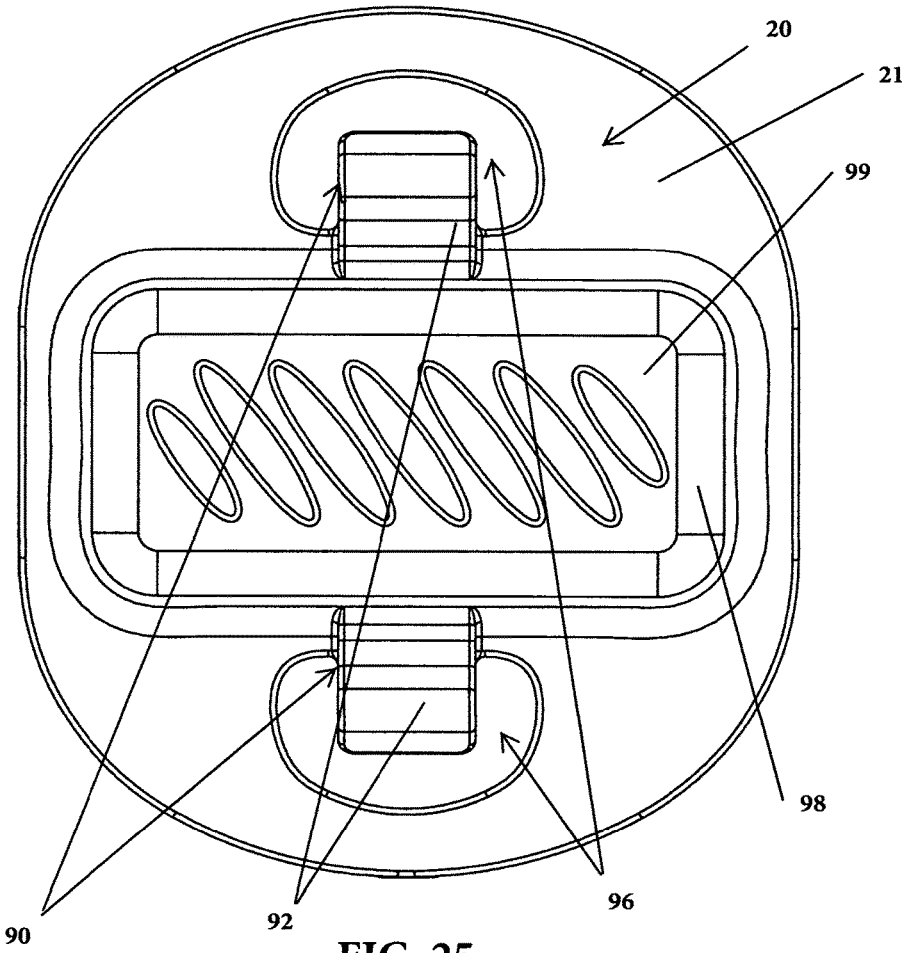
FIG. 25 is a bottom plan view of an intermediate pivotal mechanism of another alternative embodiment of the invention.
Figure 26:
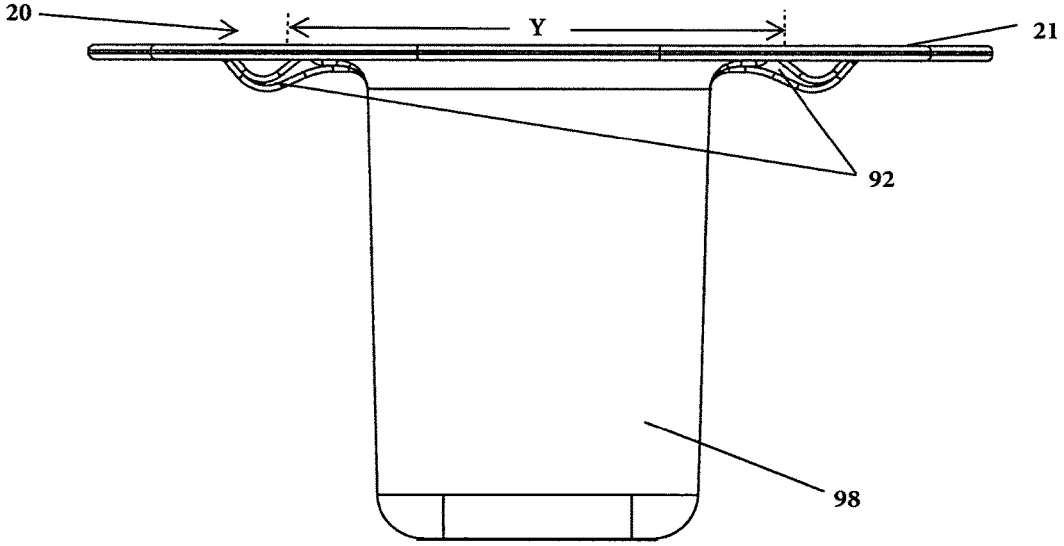
FIG. 26 is a side elevation view of an intermediate pivotal mechanism of another alternative embodiment of the invention.
Figure 27:
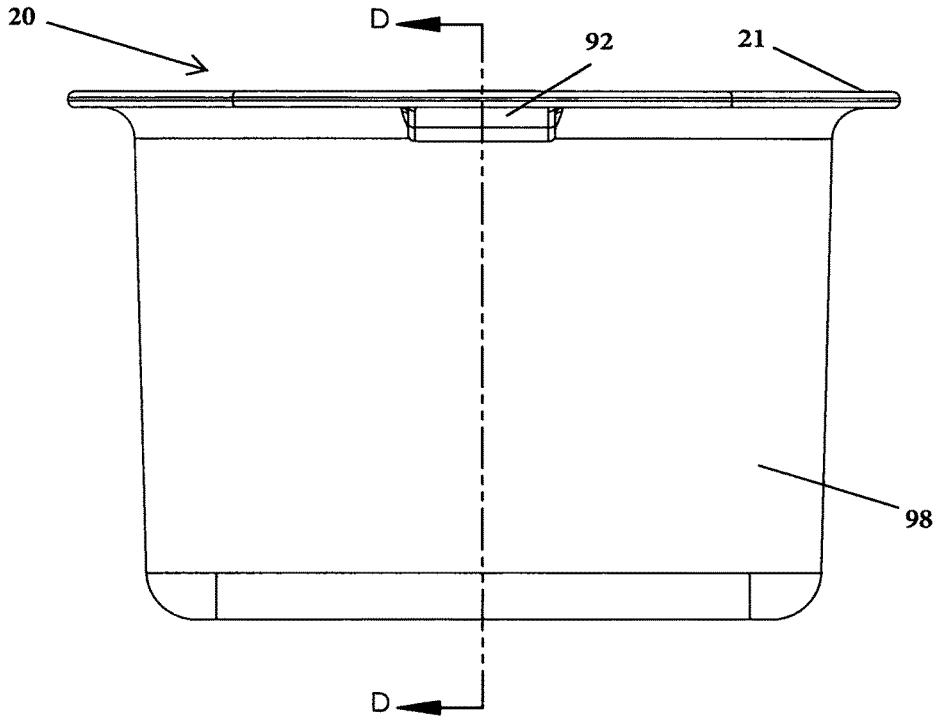
FIG. 27 is a front elevation view of an intermediate pivotal mechanism of another alternative embodiment of the invention.
Figure 28:
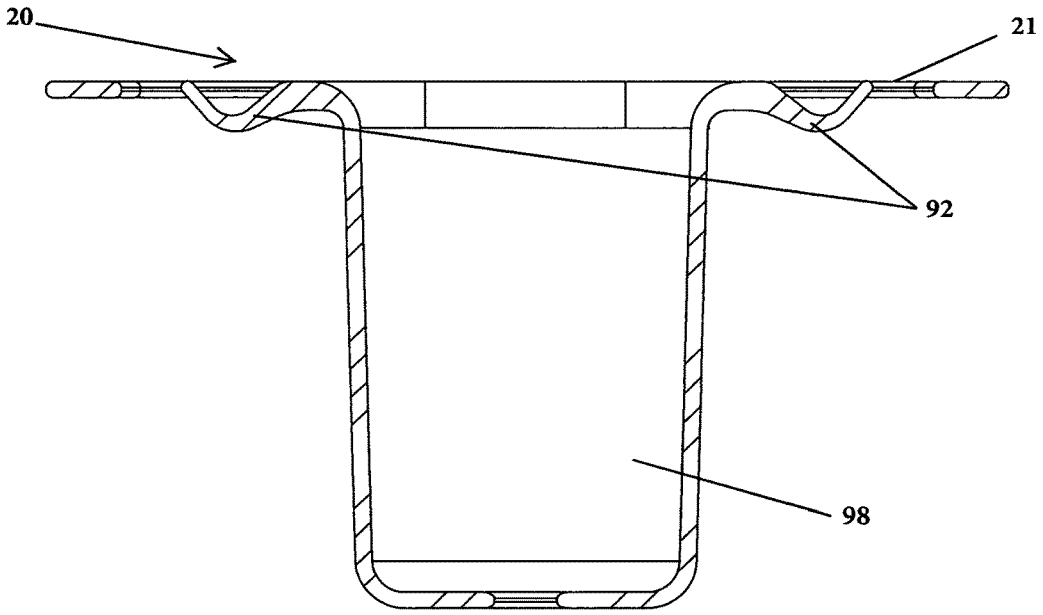
FIG. 28 is a sectional view taken along line D-D of FIG. 27.

Referring now to FIGS. 22-28, another alternative embodiment of the hammock mounted caddy 10 includes a generally rectangular item holding portion 98 integrally formed within a mounting base 20. However, it should be readily understood by those skilled in the art that the item holding portion 98 may be constructed of alternate shapes, such as square or cylindrical, without departing from the scope and spirit of the invention. It should also be readily understood by those skilled in the art that more than one item holding portion 98 may be included, without departing from the scope and spirit of the invention.

In this embodiment, the mounting base 20 includes a mounting mechanism 90. In use, the item holding portion 98 is selectively positioned between hammock cords 12 to maintain a predetermined opening Y between hammock cords 12 when the item holding portion 98 is positioned between hammock cords 12. It should be readily understood by those skilled in the art that alternatively the mounting base 20 may be immovably secured to hammock cords 12, without departing from the scope and spirit of the invention.

In this embodiment, the mounting mechanism 90 includes retention members 92 which selectively and frictionally engage hammock cords 12 when the mounting base 20 is positioned on hammock cords 12. The retention members 92 are generally u-shaped and extend downwardly through apertures 96 defined in the top surface 21 of the mounting base 20. In use, the retention members 92 frictionally engage hammock cords 12. It should also be readily understood by those skilled in the art that the retention members 92 may engage hammock cords 12 to maintain a predetermined opening Y between hammock cords 12 when the item holding portion 98 is positioned between hammock cords 12, without departing from the scope and spirit of the invention. It should also be readily understood by those skilled in the art that alternatively the retention members 92 may be a variety of known fasteners, such as clips, straps, clasps, brackets, loops, threaded fasteners, hook-and-loop fasteners, or the like, without departing from the scope and spirit of the invention.

Hence, while the invention has been described in connection with a preferred embodiment and alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum proportions for the elements of the invention, and variations in size, materials, shape, form, function and manner of operation, assembly and use, are deemed readily apparent and obvious to one skilled in the art, and all equivalent relationships described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact method, construction and operation shown and described, and accordingly, all suitable modifications and equivalents may be resorted to, falling within the scope of the invention.

What is claimed is:

1. A hammock mounted caddy comprising:

a mounting base;

a holding framework for holding a drink container; and an intermediate pivotal mechanism interposed between said mounting base and said holding framework to provide a user with hands-free and spill-resistant retention of drinks, said mounting base, said holding framework for holding a drink container, and said intermediate pivotal mechanism are pivotally connected to one another about two axes orthogonally arranged with respect to each other to provide a user with hands-free and spill-resistant retention of drinks.

2. The hammock mounted caddy of claim 1 wherein:

said holding framework comprises an upper portion having an outer peripheral surface having a pair of generally radially extending shaft portions having distal ends, said generally radially extending shaft portions being disposed at symmetrically opposed positions on said outer peripheral surface of said upper portion of said holding framework along a first pivot axis;

said intermediate pivotal mechanism is generally ring-shaped having an inner peripheral surface defining a pair of shaft carrying portions and an outer peripheral surface having a pair of generally radially extending shaft portions having distal ends, said generally radially extending shaft carrying portions being disposed at symmetrically opposed positions on said inner peripheral surface of said intermediate pivotal mechanism along said first pivot axis, and said generally radially extending shaft portions being disposed at symmetrically opposed positions on said outer peripheral surface of said intermediate pivotal mechanism along a second pivot axis, said first pivot axis and said second pivot axis intersecting at generally right angles, said shaft carrying portions of said intermediate pivotal mechanism defining apertures to pivotally receive distal ends of respective shaft portions of said holding framework, said mounting base, said holding framework, and said intermediate pivotal mechanism being concentrically connected;

said mounting base comprising a generally planar top surface defining an aperture sized to receive therethrough said intermediate pivotal mechanism, said mounting base comprising a pair of generally radially extending shaft carrying portions having distal ends, said generally radially extending shaft carrying portions being disposed at symmetrically opposed positions on said shaft carrying portions of said mounting base along the second pivot axis, said shaft carrying portions of said mounting base defining apertures to pivotally receive distal ends of respective shaft portions;

said generally radially extending shaft portions of said holding framework being received in pivotal engagement within respective shaft carrying portions of said intermediate pivotal mechanism about an axis orthogonally arranged with respect to said intermediate pivotal mechanism and said generally radially extending shaft portions being received in pivotal engagement within respective shaft carrying portions of said mounting base about an axis orthogonally arranged with respect to said mounting base, to provide a user with hands-free and spill-resistant retention of drinks; said shaft carrying portions of said mounting base defining apertures to pivotally receive distal ends of respective shaft portions; said shaft carrying portions of said intermediate pivotal mechanism defining apertures to pivotally receive distal ends of respective shaft portions.

3. A hammock mounted caddy comprising:

a mounting base constructed to engage hammock cords and adapted for supportable engagement on the hammock cords;

a holding framework for holding a drink container; and an intermediate pivotal mechanism interposed between said mounting base and said holding framework to provide a user with hands-free and spill-resistant retention of drinks.

4. The hammock mounted caddy of claim 3 wherein said mounting base further comprises a mounting mechanism.

5. The hammock mounted caddy of claim 4 wherein said mounting mechanism comprises a pair of elongated collars extending generally vertically downwardly from the top surface of said mounting base, said collars having lower flanges that extend generally horizontally outwardly therefrom, said collars adapted to selectively engage hammock cords to maintain a predetermined opening between hammock cords when said holding framework is positioned between hammock cords.

6. The hammock mounted caddy of claim 5 wherein said mounting mechanism further comprises retention members which selectively and frictionally engage hammock cords when said mounting base is positioned on hammock cords.

7. The hammock mounted caddy of claim 6 wherein said retention members are generally u-shaped and extend downwardly through apertures defined in the top surface of said mounting base to frictionally engage hammock cords.

8. The hammock mounted caddy of claim 4 wherein said mounting mechanism comprises retention members which selectively and frictionally engage hammock cords when said mounting base is positioned on hammock cords.

9. The hammock mounted caddy of claim 8 wherein said retention members are generally u-shaped and extend downwardly through apertures defined in the top surface of said mounting base to frictionally engage hammock cords.

10. The hammock mounted caddy of claim 8 wherein said mounting base further comprises a mounting mechanism.

11. The hammock mounted caddy of claim 10 wherein said retention members are generally u-shaped and extend downwardly through apertures defined in the top surface of said mounting base to frictionally engage hammock cords.

12. The hammock mounted caddy of claim 10 wherein said mounting mechanism comprises retention members which selectively and frictionally engage hammock cords when said mounting base is positioned on hammock cords.

13. A hammock mounted caddy comprising:

a mounting base constructed to engage hammock cords;

a holding framework for holding a drink container;

an intermediate pivotal mechanism interposed between said mounting base and said holding framework to provide a user with hands-free and spill-resistant retention of drinks; and at least one item holding portion integrally formed within said mounting base.

14. The hammock mounted caddy of claim 9 wherein:

said holding framework comprises an upper portion having an outer peripheral surface having a pair of generally radially extending shaft portions having distal ends, said generally radially extending shaft portions being disposed at symmetrically opposed positions on said outer peripheral surface of said upper portion of said holding framework along a first pivot axis;

said intermediate pivotal mechanism is generally ring-shaped having an inner peripheral surface defining a pair of shaft carrying portions and an outer peripheral surface having a pair of generally radially extending shaft portions having distal ends, said generally radially extending shaft carrying portions being disposed at symmetrically opposed positions on said inner peripheral surface of said intermediate pivotal mechanism along said first pivot axis, and said generally radially extending shaft portions being disposed at symmetrically opposed positions on said outer peripheral surface of said intermediate pivotal mechanism along a second pivot axis, said first pivot axis and said second pivot axis intersecting at generally right angles, said shaft carrying portions of said intermediate pivotal mechanism defining apertures to pivotally receive distal ends of respective shaft portions of said holding framework, said mounting base, said holding framework, and said intermediate pivotal mechanism being concentrically connected;

said mounting base comprising a generally planar top surface defining an aperture sized to receive therethrough said intermediate pivotal mechanism, said mounting base comprising a pair of generally radially extending shaft carrying portions having distal ends, said generally radially extending shaft carrying portions being disposed at symmetrically opposed positions on said shaft carrying portions of said mounting base along the second pivot axis, said shaft carrying portions of said mounting base defining apertures to pivotally receive distal ends of respective shaft portions;

said generally radially extending shaft portions of said holding framework being received in pivotal engagement within respective shaft carrying portions of said intermediate pivotal mechanism about an axis orthogonally arranged with respect to said intermediate pivotal mechanism and said generally radially extending shaft portions being received in pivotal engagement within respective shaft carrying portions of said mounting base about an axis orthogonally arranged with respect to said mounting base, to provide a user with hands-free and spill-resistant retention of drinks; said shaft carrying portions of said mounting base defining apertures to pivotally receive distal ends of respective shaft portions; said shaft carrying portions of said intermediate pivotal mechanism defining apertures to pivotally receive distal ends of respective shaft portions.

15. The hammock mounted caddy of claim 14 wherein said mounting mechanism further comprises retention members which selectively and frictionally engage hammock cords when said mounting base is positioned on hammock cords.

16. A hammock mounted caddy comprising:

a mounting base constructed to engage hammock cords and adapted for supportable engagement on the hammock cords;

a holding framework for holding a drink container;

an intermediate pivotal mechanism interposed between said mounting base and said holding framework to provide a user with hands-free and spill-resistant retention of drinks; and at least one item holding portion integrally formed within said mounting base, said mounting base, said holding framework for holding a drink container, and said intermediate pivotal mechanism are pivotally connected to one another about two axes orthogonally arranged with respect to each other to provide a user with hands-free and spill-resistant retention of drinks.

17. The hammock mounted caddy of claim 16 wherein said mounting mechanism comprises a pair of elongated collars extending generally vertically downwardly from the top surface of said mounting base, said collars having lower flanges that extend generally horizontally outwardly therefrom, said collars adapted to selectively engage hammock cords to maintain a predetermined opening between hammock cords when said holding framework is positioned between hammock cords.

18. The hammock mounted caddy of claim 17 wherein said retention members are generally u-shaped and extend downwardly through apertures defined in the top surface of said mounting base to frictionally engage hammock cords.

19. A hammock mounted caddy comprising:

a mounting base constructed to engage hammock cords and adapted for supportable engagement on the hammock cords; and at least one item holding portion integrally formed within said mounting base.

20. The hammock mounted caddy of claim 19 wherein said mounting base further comprises a mounting mechanism.

21. The hammock mounted caddy of claim 20 wherein said mounting mechanism comprises retention members which selectively and frictionally engage hammock cords when said mounting base is positioned on hammock cords.

22. The hammock mounted caddy of claim 21 wherein said retention members are generally u-shaped and extend downwardly through apertures defined in the top surface of said mounting base to frictionally engage hammock cords.

23. A hammock mounted caddy comprising:

a mounting base constructed to engage hammock cords and adapted for supportable engagement on the hammock cords;

a holding framework for holding a drink container; and an intermediate pivotal mechanism interposed between said mounting base and said holding framework to provide a user with hands-free and spill-resistant retention of drinks, wherein said mounting base, said holding framework for holding a drink container, and said intermediate pivotal mechanism are pivotally connected to one another about two axes orthogonally arranged with respect to each other to provide a user with hands-free and spill-resistant retention of drinks.

24. The hammock mounted caddy of claim 23 wherein:

said holding framework comprises an upper portion having an outer peripheral surface having a pair of generally radially extending shaft portions having distal ends, said generally radially extending shaft portions being disposed at symmetrically opposed positions on said outer peripheral surface of said upper portion of said holding framework along a first pivot axis;

said intermediate pivotal mechanism is generally ring-shaped having an inner peripheral surface defining a pair of shaft carrying portions and an outer peripheral surface having a pair of generally radially extending shaft portions having distal ends, said generally radially extending shaft carrying portions being disposed at symmetrically opposed positions on said inner peripheral surface of said intermediate pivotal mechanism along said first pivot axis, and said generally radially extending shaft portions being disposed at symmetrically opposed positions on said outer peripheral surface of said intermediate pivotal mechanism along a second pivot axis, said first pivot axis and said second pivot axis intersecting at generally right angles, said shaft carrying portions of said intermediate pivotal mechanism defining apertures to pivotally receive distal ends of respective shaft portions of said holding framework, said mounting base, said holding framework, and said intermediate pivotal mechanism being concentrically connected;

said mounting base comprising a generally planar top surface defining an aperture sized to receive therethrough said intermediate pivotal mechanism, said mounting base comprising a pair of generally radially extending shaft carrying portions having distal ends, said generally radially extending shaft carrying portions being disposed at symmetrically opposed positions on said shaft carrying portions of said mounting base along the second pivot axis, said shaft carrying portions of said mounting base defining apertures to pivotally receive distal ends of respective shaft portions;

said generally radially extending shaft portions of said holding framework being received in pivotal engagement within respective shaft carrying portions of said intermediate pivotal mechanism about an axis orthogonally arranged with respect to said intermediate pivotal mechanism and said generally radially extending shaft portions being received in pivotal engagement within respective shaft carrying portions of said mounting base about an axis orthogonally arranged with respect to said mounting base, to provide a user with hands-free and spill-resistant retention of drinks; said shaft carrying portions of said mounting base defining apertures to pivotally receive distal ends of respective shaft portions; said shaft carrying portions of said intermediate pivotal mechanism defining apertures to pivotally receive distal ends of respective shaft portions.

25. The hammock mounted caddy of claim 23 wherein said mounting base further comprises a mounting mechanism.

26. The hammock mounted caddy of claim 25 wherein said mounting mechanism comprises a pair of elongated collars extending generally vertically downwardly from the top surface of said mounting base, said collars having lower flanges that extend generally horizontally outwardly therefrom, said collars adapted to selectively engage hammock cords to maintain a predetermined opening between hammock cords when said holding framework is positioned between hammock cords.

27. The hammock mounted caddy of claim 26 wherein said mounting mechanism further comprises retention members which selectively and frictionally engage hammock cords when said mounting base is positioned on hammock cords.

28. The hammock mounted caddy of claim 27 wherein said retention members are generally u-shaped and extend downwardly through apertures defined in the top surface of said mounting base to frictionally engage hammock cords.

29. The hammock mounted caddy of claim 26 wherein said mounting mechanism comprises retention members which selectively and frictionally engage hammock cords when said mounting base is positioned on hammock cords.

30. The hammock mounted caddy of claim 29 wherein said retention members are generally u-shaped and extend downwardly through apertures defined in the top surface of said mounting base to frictionally engage hammock cords.

31. The hammock mounted caddy of claim 30 wherein:

said holding framework comprises an upper portion having an outer peripheral surface having a pair of generally radially extending shaft portions having distal ends, said generally radially extending shaft portions being disposed at symmetrically opposed positions on said outer peripheral surface of said upper portion of said holding framework along a first pivot axis;

said intermediate pivotal mechanism is generally ring-shaped having an inner peripheral surface defiling a pair of shaft carrying portions and an outer peripheral surface having a pair of generally radially extending shaft portions having distal ends, said generally radially extending shaft carrying portions being disposed at symmetrically opposed positions on said inner peripheral surface of said intermediate pivotal mechanism along said first pivot axis, and said generally radially extending shaft portions being disposed at symmetrically opposed positions on said outer peripheral surface of said intermediate pivotal mechanism along a second pivot axis, said first pivot axis and said second pivot axis intersecting at generally right angles, said shaft carrying portions of said intermediate pivotal mechanism defining apertures to pivotally receive distal ends of respective shaft portions of said holding framework, said mounting base, said holding framework, and said intermediate pivotal mechanism being concentrically connected;

said mounting base comprising a generally planar top surface defining an aperture sized to receive therethrough said intermediate pivotal mechanism, said mounting base comprising a pair of generally radially extending shaft carrying portions having distal ends, said generally radially extending shaft carrying portions being disposed at symmetrically opposed positions on said shaft carrying portions of said mounting base along the second pivot axis, said shaft carrying portions of said mounting base defining apertures to pivotally receive distal ends of respective shaft portions;

said generally radially extending shaft portions of said holding framework being received in pivotal engagement within respective shaft carrying portions of said intermediate pivotal mechanism about an axis orthogonally arranged with respect to said intermediate pivotal mechanism and said generally radially extending shaft portions being received in pivotal engagement within respective shaft carrying portions of said mounting base about an axis orthogonally arranged with respect to said mounting base, to provide a user with hands-free and spill-resistant retention of drinks; said shaft carrying portions of said mounting base defining apertures to pivotally receive distal ends of respective shaft portions; said shaft carrying portions of said intermediate pivotal mechanism defining apertures to pivotally receive distal ends of respective shaft portions.

32. The hammock mounted caddy of claim 31 wherein said mounting mechanism comprises a pair of elongated collars extending generally vertically downwardly from the top surface of said mounting base, said collars having lower flanges that extend generally horizontally outwardly therefrom, said collars adapted to selectively engage hammock cords to maintain a predetermined opening between hammock cords when said holding framework is positioned between hammock cords.

33. The hammock mounted caddy of claim 32 wherein said retention members are generally u-shaped and extend downwardly through apertures defined in the top surface of said mounting base to frictionally engage hammock cords.

34. The hammock mounted caddy of claim 32 wherein said mounting mechanism comprises retention members which selectively and frictionally engage hammock cords when said mounting base is positioned on hammock cords.

35. The hammock mounted caddy of claim 29 wherein said mounting base further comprises a mounting mechanism.

36. The hammock mounted caddy of claim 35 wherein said mounting mechanism further comprises retention members which selectively and frictionally engage hammock cords when said mounting base is positioned on hammock cords.

37. The hammock mounted caddy of claim 36 wherein said retention members are generally u-shaped and extend downwardly through apertures defined in the top surface of said mounting base to frictionally engage hammock cords.

38. A hammock mounted caddy comprising:

a mounting base constructed to engage hammock cords and adapted for supportable engagement on the hammock cords;

a holding framework for holding a drink container;

an intermediate pivotal mechanism interposed between said mounting base and said holding framework to provide a user with hands-free and spill-resistant retention of drinks; wherein said mounting base, said holding framework for holding a drink container, and said intermediate pivotal mechanism are pivotally connected to one another about two axes orthogonally arranged with respect to each other to provide a user with hands-free and spill-resistant retention of drinks.

* * * * *